US006793444B2

(12) United States Patent
Kondo et al.

(10) Patent No.: US 6,793,444 B2
(45) Date of Patent: Sep. 21, 2004

(54) MECHANICAL ANCHOR

(75) Inventors: Shigeki Kondo, Chiba (JP); Katsuyoshi Aoyama, Tokyo (JP)

(73) Assignees: Kabushikigaisha Jiban Shikenjo, Tokyo (JP); Koyo Kogyo Kabushikigaisha, Tokyo (JP)

( * ) Notice: Subject to any disclaimer, the term of this patent is extended or adjusted under 35 U.S.C. 154(b) by 0 days.

(21) Appl. No.: 10/127,466

(22) Filed: Apr. 23, 2002

(65) Prior Publication Data

US 2002/0192034 A1 Dec. 19, 2002

(30) Foreign Application Priority Data

Jun. 11, 2001 (JP) ..... 2001-176186

(51) Int. Cl.[7] ..... E02D 5/80; E21D 20/00; E21D 21/00; E21B 4/18

(52) U.S. Cl. ..... 405/259.3; 175/98; 405/262; 52/156; 52/160

(58) Field of Search ..... 52/155–160; 175/94, 175/98; 405/244, 258, 259.1, 259.3, 202

(56) References Cited

U.S. PATENT DOCUMENTS

| | | | | | |
|---|---|---|---|---|---|
| 1,807,488 | A | * | 5/1931 | Michalicek | 52/159 |
| 2,637,527 | A | * | 5/1953 | Andrews, Jr. | 175/94 |
| 3,187,858 | A | * | 6/1965 | Champs | 52/160 |
| 3,343,614 | A | * | 9/1967 | Parisien | 175/19 |
| 4,160,613 | A | * | 7/1979 | Stanwick | 405/244 |
| 4,247,222 | A | * | 1/1981 | Schosek | 405/184 |
| 4,342,527 | A | * | 8/1982 | White | 405/259.3 |
| 4,547,106 | A | * | 10/1985 | Lipsker | 405/259.3 |
| 4,882,891 | A | * | 11/1989 | Sero et al. | 52/741.15 |
| 5,599,140 | A | * | 2/1997 | Wright | 405/259.6 |
| 5,622,015 | A | * | 4/1997 | Collins | 52/160 |
| 6,210,077 | B1 | | 4/2001 | Kondo | |

FOREIGN PATENT DOCUMENTS

| | | |
|---|---|---|
| JP | 52-46013 | 4/1977 |
| JP | 4-13496 | 3/1992 |
| JP | 11256574 | 9/1999 |

OTHER PUBLICATIONS

Partial English Translation for JP Appln. No. 52–46013.
Partial English Translation for JP Appln. No. 4–13496.
Partial English TRanslation for JP Appln. No. 11–256574.

* cited by examiner

*Primary Examiner*—David Bagnell
*Assistant Examiner*—Jennifer H Gay
(74) *Attorney, Agent, or Firm*—Greenblum & Bernstein, P.L.C.

(57) ABSTRACT

A mechanical anchor includes an anchor unit that is divided into a plurality of divided anchor units which are movably connected to a tension rod to be moved in lateral directions. The anchor unit is opened or closed by the movement of the divided anchor units, and the anchor unit forms a cylindrical shape when the divided anchor units are closed. A driving member for opening or closing the anchor unit is mounted on an inner side of the anchor unit in such manner that the driving member is extended in a longitudinal direction of the anchor unit. The driving member and each of the divided anchor units are connected with each other so that the driving force of the driving member is equally applied on each of the divided anchor units.

5 Claims, 6 Drawing Sheets

MECHANICAL ANCHOR

BACKGROUND OF THE INVENTION

1. Field of the Invention

The present invention relates to a mechanical anchor to be used as a reaction force resisting unit in a loading test for pile or subsoil, in a cone penetration test in subsoil exploration, and in a press-in operation for pile, caisson, etc. In particular, the present invention relates to a so-called pre-boring type mechanical anchor reusable by recovering after the first use and to be placed into an anchor hole formed in advance.

2. Description of the Background Art

A recovery type conventional mechanical anchor used commonly in the past comprises a tension rod connected to a support mechanism installed on the ground, an anchor unit divided longitudinally into two parts and connected to the tension rod so that the divided anchor units can be moved in lateral direction, and a fluid pressure jack arranged on inner side of the anchor unit and used for opening or closing the anchor units. In this jack, a cylinder is disposed in lateral direction so that a piston rod is brought in or out in a direction perpendicular to inner surface of each of the divided anchor units. When the anchor unit is lifted up and suspended by the support mechanism, hydraulic pressure is supplied into the fluid pressure jack, and the piston rod is protruded to open the divided anchor units. The anchor units are brought into close contact with the subsoil, and resisting force against tensile force is increased. This prior art is disclosed, for instance, in Japanese Utility Model Publication Laid-Open 52-46013, Japanese Patent Publication 4-13496, Japanese Patent Publication Laid-Open 11-256574, and U.S. Pat. No. 6,210,077 B1.

However, in the conventional type mechanical anchor as described above, the fluid pressure jack is disposed in lateral direction, and it is not possible to design the fluid pressure jack with a length shorter than a predetermined value, and it is difficult to design the anchor unit with smaller diameter. This is an important problem because, in a pre-boring type mechanical anchor, which is inserted into an anchor hole formed in advance, the above design gives adverse effect on the diameter of the anchor hole.

For instance, in the screw type reaction pile as described in Japanese Utility Model Publication Laid-Open 52-46013, the cylinder is arranged between screw shafts longitudinally divided into two parts and in a direction perpendicular to the screw shafts. In this case, diameter of the screw shaft when the anchor units are opened is determined by the sum of the length of the cylinder and the stroke of the cylinder rod. Thus, it is not possible to manufacture a small caliber type reaction pile with diameter of 300 mm or less.

The present inventors have experimentally found follows: When a load is applied on the subsoil in lateral direction using the divided anchor units, the subsoil can be compressed and effective shearing section can be formed in a range with a central angle of 70° to 80°. From these results, it can be understood that, if the number of the divided anchor units is preferably 3 or 4 rather than 2 because this makes it possible to increase the shearing sectional area and to induce higher anchoring force. However, in the conventional example with the jack arranged in lateral direction, it is practically impossible to design the divided anchor units in three or more divided parts because this requires more complicated structure in the connection between the divided anchor units and the jack.

The Japanese Patent Publication 4-13496 discloses a structure with the cylinder arranged in longitudinal direction. Specifically, one end of the cylinder is mounted on one of the divided anchor units, and an inclined surface in contact with the tip of the piston rod is provided inside the divided anchor units. In this case, a force in horizontal direction is applied on the mounting portion of one of the divided anchor units. As a result, the forces applied on the two divided anchor units are not equal to each other. This results in such a problem that the opening of the divided anchor units differs widely from each other.

SUMMARY OF THE INVENTION

To solve the above problems, it is an object of the present invention to provide a mechanical anchor, which is designed with small caliber and easy to handle, and which can be recovered and re-used and is suitable for the so-called pre-boring type with a boring hole formed in advance.

To attain the above object, the mechanical anchor of the present invention comprises an anchor unit in cylindrical shape connected to a tension rod, said anchor unit being equally divided longitudinally into 3 or 4 parts (divided anchor units), each of the divided anchor units is moved in parallel in lateral direction, and a driving member is provided in longitudinal direction to open or close the anchor units so that driving force is equally applied on the divided anchor units on upper and lower sides of the driving member.

As the driving member, it is preferable to use a fluid pressure cylinder such as hydraulic cylinder or air cylinder.

For the purpose of equally transmitting the driving force of the driving member, a mounting fixture having a mounting portion facing to each of the divided anchor units is provided on upper and lower ends of the driving member, and it is preferable to connect each mounting portion with each of the divided anchor units facing to it using a link arm, which is moved by the driving force of the driving member.

DETAILED DESCRIPTION OF THE PREFERRED EMBODIMENT

Figure 1:
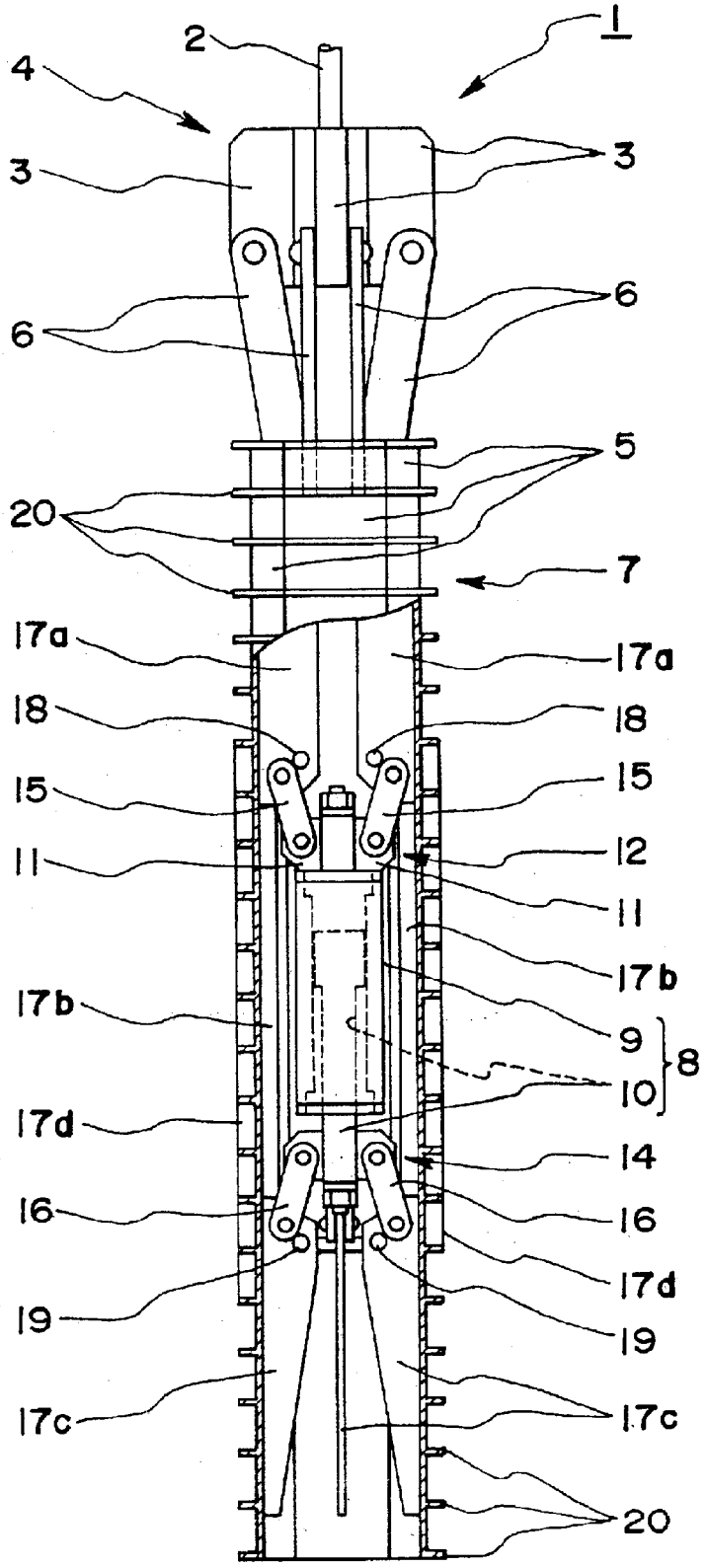
FIG. 1 is a partial longitudinal sectional view seen from front side of a mechanical anchor when anchor unit is closed.
Figure 2:
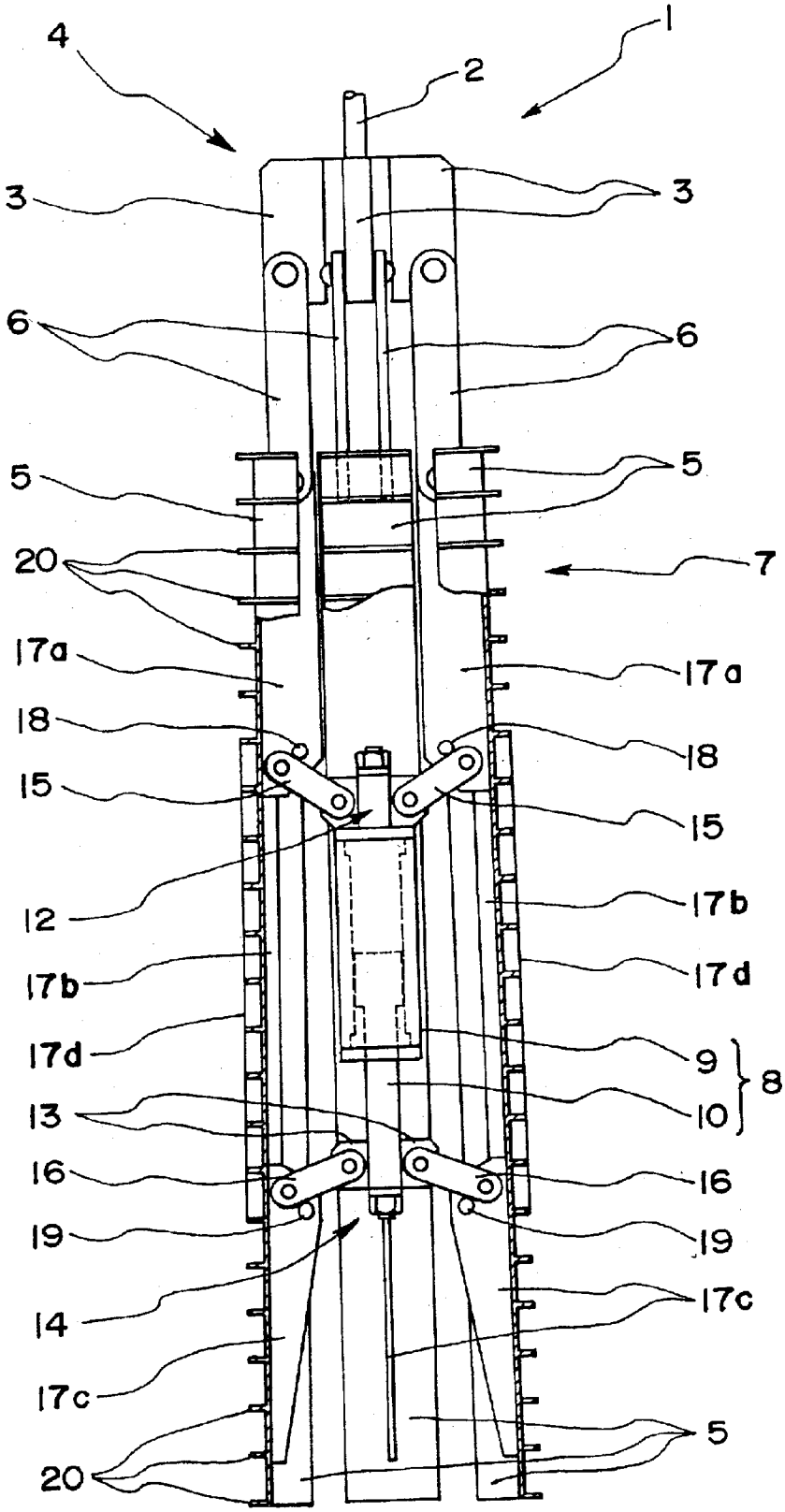
FIG. 2 is a partial longitudinal sectional view seen from front side of a mechanical anchor when anchor unit is opened.
Figure 3:
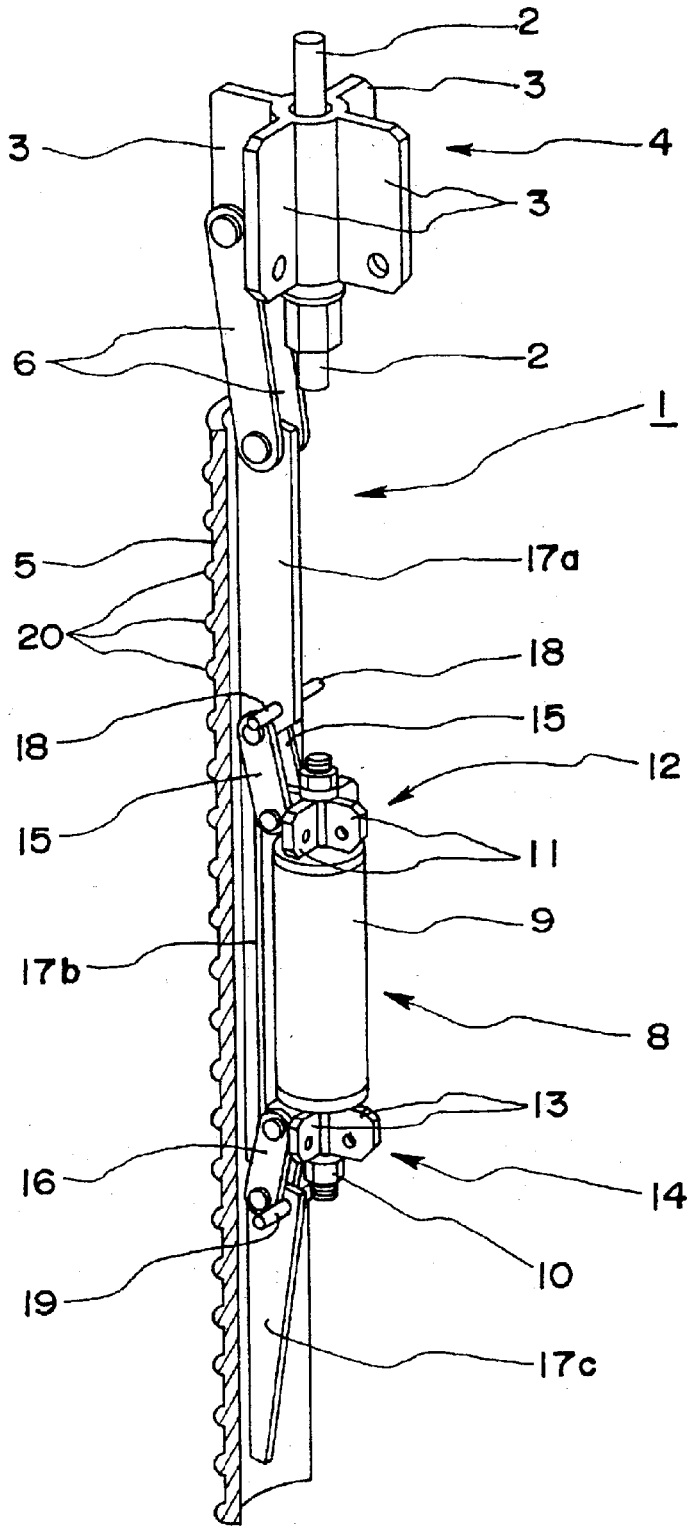
FIG. 3 is a perspective view of a divided anchor unit showing connecting condition of a driving member and a tension rod.

As shown in FIG. 1 to FIG. 3, a mechanical anchor 1 comprises a tension rod 2 connected to a support mechanism (not shown) installed on the ground, a fixing unit 4 mounted on the lower end of the tension rod 2 and having four fixing plates 3 projected radially in four directions respectively with equal spacing, an anchor unit 7 longitudinally divided to four divided anchor units 5 connected to each of the fixing plates 3 respectively via a link bar 6 so that each divided anchor unit is movable in lateral direction, each of said divided anchor units being opened or closed and being turned to cylindrical shape when closed, and a hydraulic cylinder 8 serving as a driving member for opening or closing the anchor units. The mechanical anchor 1 is inserted into a pre-boring hole formed in a relatively firm subsoil in advance with the divided anchors in closed state. After the anchor is inserted, the divided anchor units are opened to increase anchoring force. It is used for a test to confirm supporting force of subsoil or small-caliber anchor, or in a cone penetration test in subsoil exploration. After the use, the divided anchor units are closed again and are put back.

The hydraulic cylinder 8 comprises a cylinder main unit 9 and a cylinder rod 10 to be placed into or out of one end of the cylinder main unit 9. By hydraulic force to be controlled by a hydraulic pressure feeding mechanism (not shown) installed on the ground, the cylinder rod 10 is brought in or out. The hydraulic cylinder 8 is disposed on inner side of the anchor unit 7 in such manner that it is extended in longitudinal direction of the anchor unit 7, i.e. in vertical direction. On a rear end of the hydraulic cylinder 8, i.e. on the upper end of the cylinder main unit 9, a first arm mounting fixture 12 is provided, and four mounting plates 11 are radially protruded in four directions with equal spacing. Also, on a protruding end of the cylinder rod 10 at a tip of the hydraulic cylinder 8, a second arm mounting fixture 14 having four mounting plates 13 radially protruding in four directions with equal spacing is provided. In axial hole of each of the mounting plates 11 and 13 of the first and the second mounting arms 12 and 14, one end of each of a first and a second link arms 15 and 16 is pivotally mounted.

As shown in FIG. 1 to FIG. 5, on inner periphery of each of the divided anchor units 5, a first, a second, and a third reinforcing plates 17*a,* 17*b* and 17*c* extending in longitudinal direction are arranged in this order downward from above. Near the upper end of the first reinforcing plate 17*a,* an axial hole is provided, and the other end of the link bar 6 pivotally supported on the fixing plate 3 of the fixing unit 4 is pivotally mounted in the axial hole. Near the lower end of the first reinforcing plate 17*a,* there is provided an axial hole, and the other end of the first link arm 15 is pivotally mounted in this hole. Near the lower end of the first reinforcing plate 17*a,* a stopper 18 is mounted to control vibration of each of the first link arms 17.

Near the upper end of the third reinforcing plate 17*c,* an axial hole is provided, in which the other end of the second link arm 16 is pivotally supported in the hole, and a stopper 19 is mounted, which is used to control vibration of the second link arm 16. On outer peripheral surface of the divided anchor unit 5, a fourth reinforcing plate 17*d* is provided at a position to match the second reinforcing plate 17*b.*

As shown in FIG. 1 to FIG. 7, an anti-slipping member 20 comprising a multiple of ridges extending longitudinally in circumferential direction with a certain spacing is mounted on outer surface of each of the divided anchor units 5. These anti-slipping members 20 are used to increase friction between the anchor unit 7 and the subsoil and to generate higher resisting force against a force to lift up the mechanical anchor 1.

Figure 4:
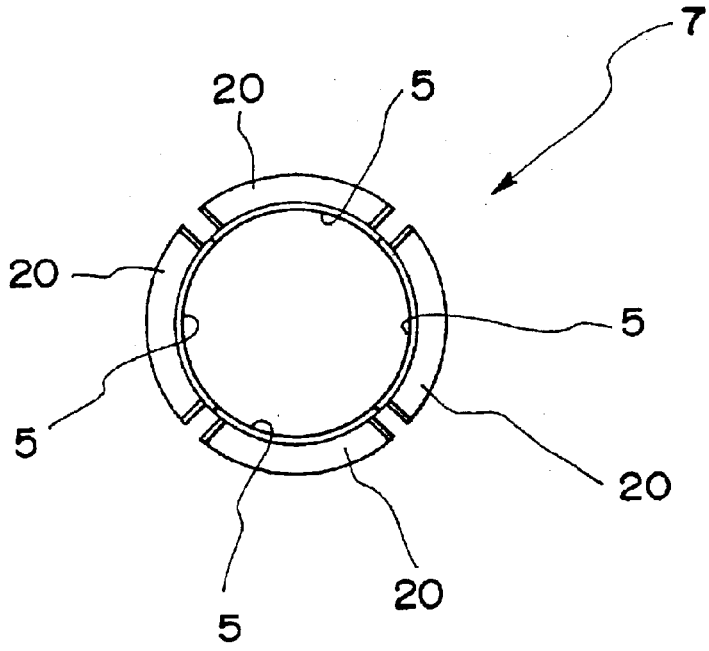
FIG. 4 is a plan view of an anchor unit when it is closed.
Figure 5:
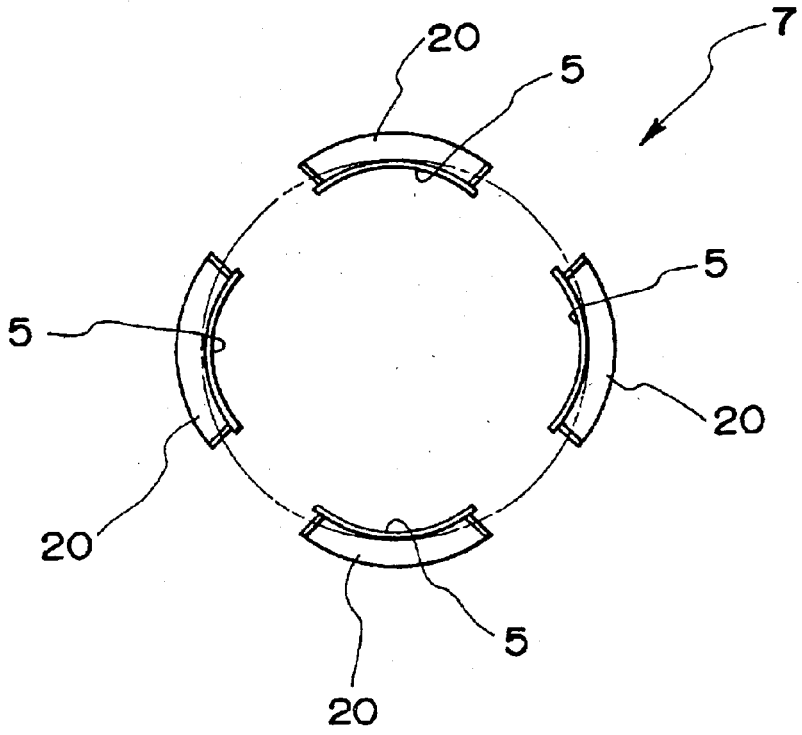
FIG. 5 is a plan view of an anchor unit when it is opened.
Figure 6:
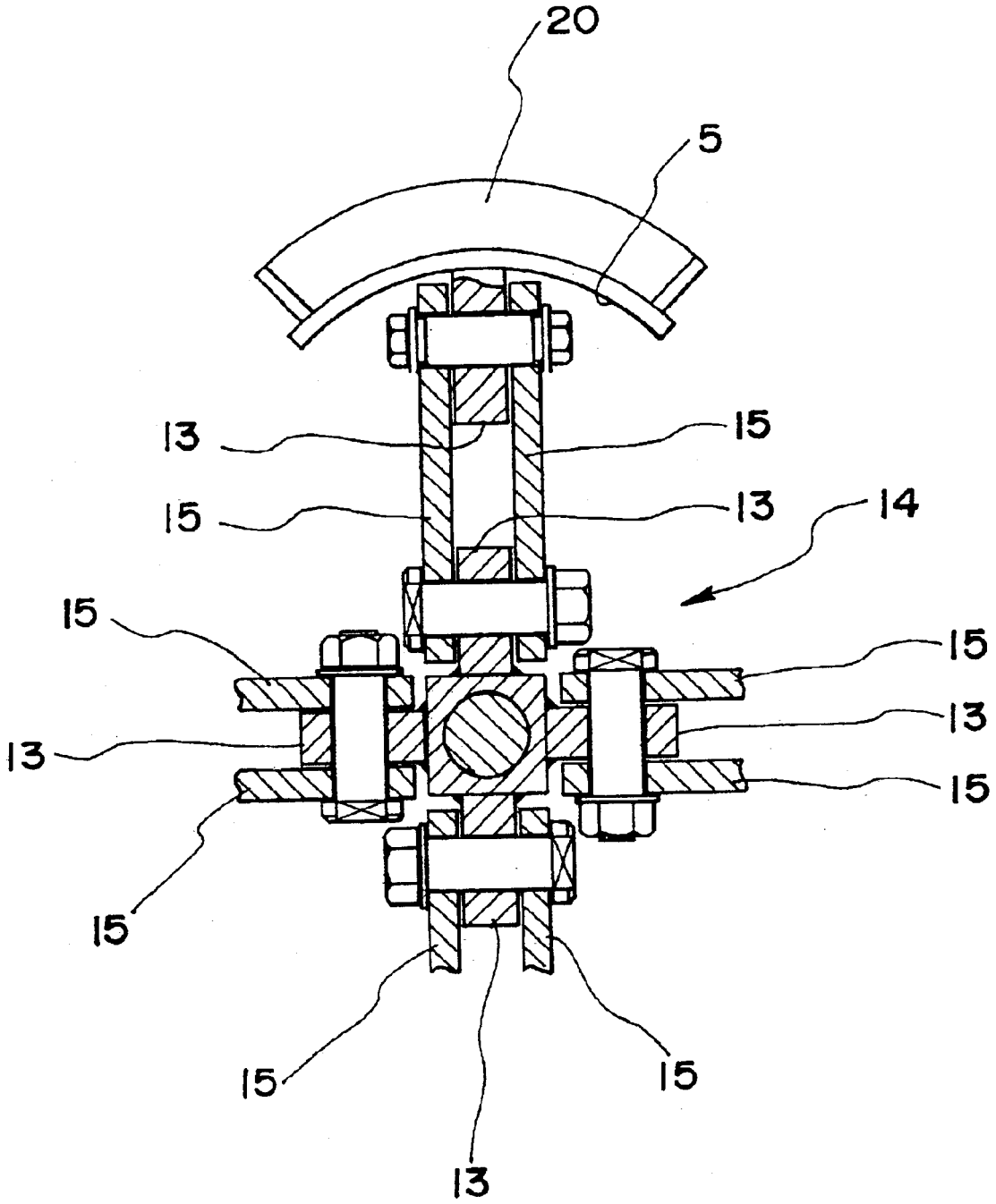
FIG. 6 is an enlarged partial cross-sectional view seen from above showing a divided anchor and a cylinder.
Figure 7:
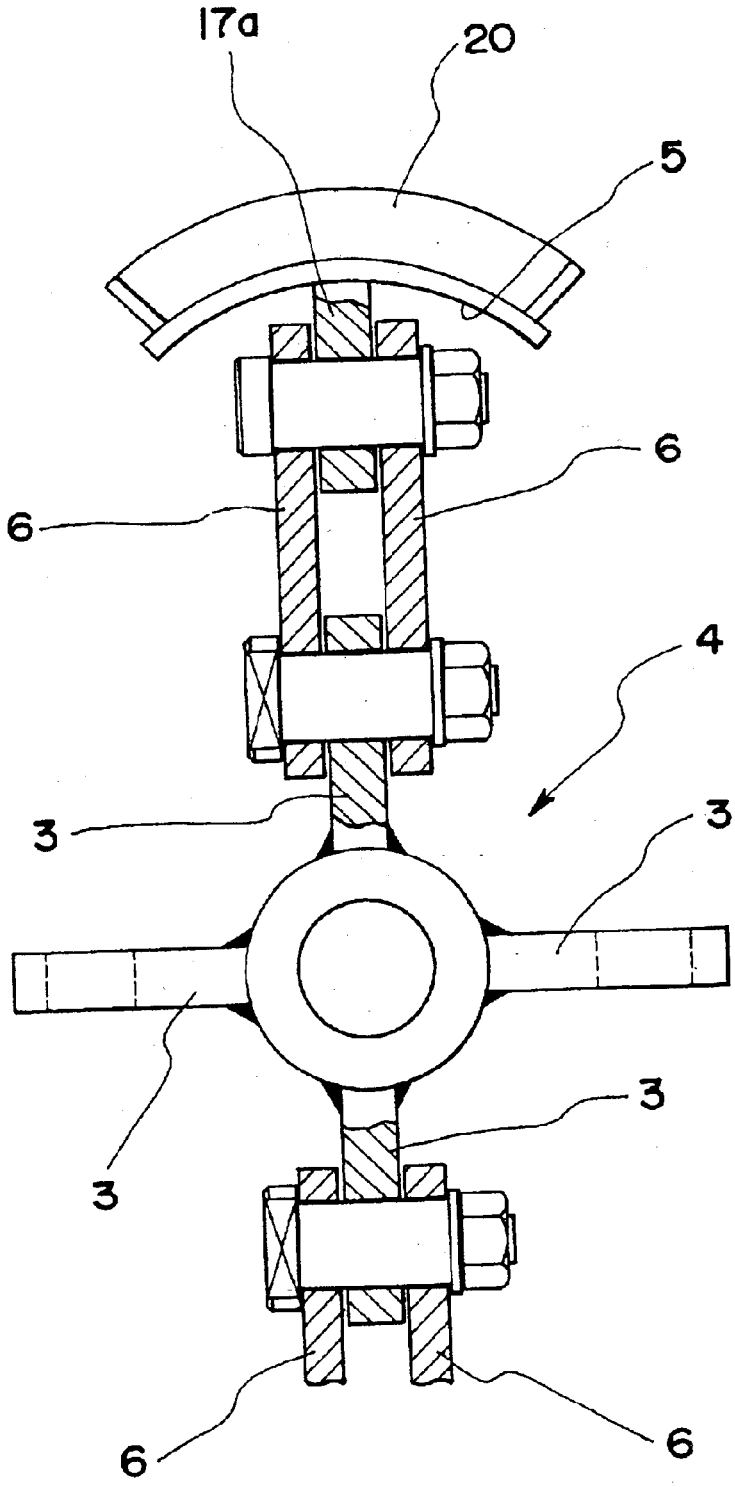
FIG. 7 is an enlarged partial cross-sectional view showing connecting condition of a divided anchor unit and a tension rod.

The mechanical anchor 1 with the above arrangement is lifted up and suspended by a support mechanism (not shown) installed on the ground with the anchor units 7 in closed state (FIG. 1 and FIG. 4). Then, the anchor unit is placed into a pre-boring hole (not shown) formed in advance in the subsoil. Hydraulic pressure is applied into the cylinder main unit 9 from a hydraulic pressure feeding mechanism (not shown) installed on the ground, and the cylinder rod 10 is protruded. When the cylinder rod 10 is protruded, the first and the second link arms 15 and 16 are moved and opened outward. The divided anchor units 5 are opened in outward direction, and the anchor unit 7 is opened (FIG. 2). This opening operation is stopped when the first and the second link arms 15 and 16 hit the stoppers 18 and 19. On the other hand, the link bar 6 on upper portion of each of the divided anchor units 5 is also moved. Each of the divided anchor units 5 is moved in parallel and is displaced in outward direction and is stopped.

When the anchor unit 7 is opened as described above, each of the divided anchor units 5 is pressed against side wall of the subsoil in the pre-boring hole. This generates higher withdrawing resistance force (anchoring force). The anti-slipping members 20 shear the subsoil and are engaged in it, and high friction force is generated, and the anchoring force is further increased. In general, when a load is applied in lateral direction using the divided anchor units 5, the subsoil is compressed, and an effective shearing sectional area is formed in the range with a central angle of 70° to 80°. When the divided anchor unit 5 divided into four parts in the anchor unit 7 is opened, the shearing sectional area is larger than the case of a conventional type anchor unit divided into two parts. As a result, the anchoring force is increased.

When the anchor unit 7 is opened and if it is opened too widely, the subsoil is destroyed. Slipping surface is generated on the subsoil, and the anchoring force is decreased. As the angle of each of link arms 15 and 16 is changed and the arms are moved closer to horizontal direction, strong force in horizontal direction is applied on the anchor unit 7, and the anchor unit 7 may be deformed. The stoppers 18 and 19 are effective to prevent the anchor unit 7 from opening too widely. For the purpose of preventing the anchor unit 7 from opening more widely than required, the moving range of the link arms 15 and 16 is controlled, and opening operation is stopped before the subsoil is destroyed.

After the mechanical anchor 1 has been used for the purpose such as the loading test, the hydraulic pressure in the hydraulic cylinder 8 is withdrawn, and the cylinder rod 10 is brought into the cylinder. Then, the anchor unit 7 is closed and is brought back.

The present invention is not limited to the above embodiment. For instance, instead of designing the anchor unit 7 divided to four divided anchor units 5 as described above, the anchor unit 7 may comprise 3 divided anchor units or 5 or more divided anchor units. In this case, the number of the fixing plates 3 and the mounting plates 11 and 13 must be consistent with the number of the divided anchor units 5. Also, the positions of the stoppers 18 and 19 are not limited to the positions of the reinforcing plates 17*a* and 17*c*. The driving member is not limited to the hydraulic cylinder 8, and an air cylinder or other component using the other type of fluid pressure may be used.

As it is evident from the above description, according to the present invention, the driving member 8 such as hydraulic cylinder is arranged in such manner that it is extended in the same direction as the longitudinal direction of the anchor unit 7. As a result, the anchor unit 7 can be designed in small caliber type, and it is easier to handle. Also, it can cope with a small-caliber pre-boring hole, and this makes it possible to perform excavation in easier manner.

When there are 3 or more divided anchor units compared with the conventional type anchor unit divided into 2 parts, inequality in the opening of the divided anchor units 5 induced by the difference of the subsoil hardness can be minimized. Also, it is possible to minimize the risk such as poor sliding operation of the cylinder rod 10 to the cylinder main unit 9 or damage of the cylinder rod. Further, it is possible to have larger shearing sectional area.

When the stoppers 18 and 19 are provided for controlling the range of movement of the link arms 15 and 16, it is possible to prevent the anchor unit 7 from opening too widely and destroying the subsoil, or it is possible to prevent the decrease of the anchoring force caused by the generation of slipping surface in the subsoil.

In addition, a multiple of anti-slipping members 20 are provided on outer surface of the anchor unit 7 in longitudinal direction of the anchor unit 7 with equal spacing, and the anti-slipping members 20 shear the subsoil and are engaged in it. As a result, high friction force is induced, and this contributes to the increase of the anchoring force.

What is claimed is:

1. A mechanical anchor, comprising a tension rod, a fixing unit mounted on the lower end of the tension rod, an anchor unit having a longitndinal axis and being divided into a plurality of longitudinally divided anchor units, the upper end of each of said divided anchor units being connected to said fixing unit via a movable link bar so that the divided anchor units can be moved in respective lateral directions substantially transverse to the longitudinal axis, while being maintained in orientations substantially parallel to the longitudinal axis, said divided anchor units being opened or closed when the divided anchor units are moved in the respective lateral directions, said divided anchor forming a cylindrical shape when closed, said mechanical anchor further comprising a driving member arranged on an inner side of the anchor unit in such manner that the driving member is extended longitudinally in a direction substantially parallel to the longitudinal axis of the anchor unit, and the upper and lower ends of the driving member are connected respectively to each of said divided anchor units via movable link arms.

2. The mechanical anchor according to claim 1, wherein said driving member is a fluid pressure cylinder.

3. The mechanical anchor according to claim 1, wherein said anchor unit comprises at least 3 divided anchor units.

4. The mechanical anchor according to claim 1, wherein a stopper for controlling the movement of the link arm is provided on an inner surface of the anchor unit.

5. The mechanical anchor according to claim 1, wherein there are provided a multiple of anti-slipping members arranged in the longitudinal direction of the anchor unit with a predetermined spacing.

* * * * *